US005165276A

United States Patent [19]

Thiercelin

[11] Patent Number: 5,165,276

[45] Date of Patent: Nov. 24, 1992

[54] DOWNHOLE MEASUREMENTS USING VERY SHORT FRACTURES

[75] Inventor: Marc J. Thiercelin, Cambridge, England

[73] Assignee: Schlumberger Technology Corporation, Houston, Tex.

[21] Appl. No.: 802,388

[22] Filed: Dec. 4, 1991

[30] Foreign Application Priority Data

Dec. 7, 1990 [GB] United Kingdom ..... 9026703

[51] Int. Cl.[5] ..... E21B 49/00; E21B 43/26

[52] U.S. Cl. ..... 73/155; 73/784; 166/250; 166/308

[58] Field of Search ..... 73/155, 784; 166/250, 166/308

[56] References Cited

U.S. PATENT DOCUMENTS

| | | | |
|---|---|---|---|
| 3,602,308 | 8/1971 | Vincent | 166/308 |
| 4,372,380 | 2/1983 | Smith et al. | 73/155 X |
| 4,398,416 | 8/1983 | Nolte | 73/155 |
| 4,453,595 | 6/1984 | Lagus et al. | 166/250 |
| 4,660,415 | 4/1987 | Bouteca | 73/155 |
| 4,665,984 | 5/1987 | Hayashi et al. | 73/784 |
| 4,836,280 | 6/1989 | Soliman | 166/250 |
| 4,860,581 | 8/1989 | Zimmerman et al. | 73/155 |
| 4,936,139 | 6/1990 | Zimmerman et al. | 73/155 |
| 5,005,643 | 4/1991 | Soliman et al. | 73/155 X |
| 5,050,674 | 9/1991 | Soliman et al. | 73/155 X |

FOREIGN PATENT DOCUMENTS

| | | |
|---|---|---|
| 0146324 | 6/1985 | European Pat. Off. . |
| 2060903 | 5/1981 | United Kingdom . |
| 2220686 | 1/1990 | United Kingdom . |

OTHER PUBLICATIONS

Proceedings of the International Symposium on Rock Stress and Rock Stress Measurement/Stockholm/1-3 Sep. 1986, pp. 313-322.

*Primary Examiner*—Hezron E. Williams
*Assistant Examiner*—Michael Brock
*Attorney, Agent, or Firm*—John J. Ryberg; Martin Hyden

[57] ABSTRACT

A method of performing small scale micro hydraulic fracturing in which fluid is pumped into the test interval until the initiation of a fracture is indicated, immediately after which fluid is pumped out of the interval so as to prevent propagation of the fracture and allow closure thereof, the portion then being repressurized by pumping fluid back in. By pumping out when the fracture is initiated, propagation is substantially prevented allowing estimation of the fracture length and toughness to be obtained and the time taken for the measurement reduced.

20 Claims, 2 Drawing Sheets

DOWNHOLE MEASUREMENTS USING VERY SHORT FRACTURES

The present invention relates to a method of performing rock fracture measurements which is particularly useful for making in-situ measurements of stress, fracture toughness and fracture size in a borehole.

When drilling well boreholes in rock such as in oil exploration, a knowledge of the minimum stress and fracture toughness of the rocks being drilled are important for the planning of the drilling operation and any fracturing operations prior to production from the well. The fracture currently used to measure minimum stress in such circumstances is known as micro-hydraulic fracture (μHF). In μHF a short section of the borehole or well, the test interval, is isolated using inflatable packers. A fluid is then injected into the interval using pump at surface level while the pressure is monitored. A typical borehole pressure (BHP) v. time (T) plot for μHF is shown in FIG. 1. The pressure in the interval is increased until a tensile fracture is initiated. This is often recognised by a sharp fall in pressure gradient (B), known as the breakdown pressure. However, fracture initiation may occur before the breakdown is observed. After breakdown the pressure stabilizes (S) during which time the fracture propagates through the rock perpendicular to the rock minimum stress direction. When the pressure stabilizes, pumping is ceased and a downhole shut-off tool is used to shut-in the interval in order to minimize any storage effects due to the wellbore and the pressure in the interval is monitored using a downhole pressure sensor. The pressure recorded when the interval is shut-in, the Instantaneous Shut-In Pressure (ISIP) is assumed to provide a good indication of the minimum stress. The closure stress (C) can be estimated from the pressure measurement by determining the point at which the pressure decline deviates from a linear dependence on the square-root of shut-in time.

Variations on the μHF technique described above include step-rate tests and flow back tests. In the latter, the well is shut-in as before and fluid is allowed to flow back from the interval, typically at 10% of the pump-in rate. Monitoring the pressure during flow back can be used to estimate the pressure at which the fracture closes and hence the minimum stress.

In the technique described above, the fluid used is usually a low viscosity fluid such as mud or water and typically not more than 400 l are injected into the formation at flow rates of 0.05–1.0 l/s. Several injection/-fall off cycles are performed until repeatable results are obtained. This can take up to three hours. However, despite the long time taken, the estimation of minimum stress may include error of the order of several MPa, especially when the formation is permeable such that pressure leaks from the fracture face.

It is an object of the present invention to provide a method which can be used to make more accurate estimations of minimum stress in a shorter time than with the previously proposed techniques.

According to the present invention, there is provided a method of performing rock fracture measurements in a borehole, comprising isolating a portion of the borehole and alternately pumping a fluid into and removing fluid from said portion so as to increase and decrease the pressure therein respectively while continuously monitoring the fluid pressure in the portion, characterised in that the fluid is pumped into the portion until the initiation of a fracture is indicated, immediately after which fluid is pumped out of the portion so as to prevent propagation of the fracture and allow closure thereof, the portion then being repressurized by pumping fluid back in.

By pumping out when the fracture is initiated, propagation is substantially prevented allowing estimation of the fracture length and toughness to be obtained during repressurization and the time taken for the measurement reduced.

Where appropriate, the pumping in and out can be repeated to obtain several measurements. The pump out rate is preferably the same as the pump in rate and is typically $1-100\times10^{-4}$ liter/sec$^{-1}$ for low permeability formations.

The fracture should be kept as short as possible, typically no greater than about 1 m in length.

Pumping in and out is preferably achieved using a constant displacement pump. For accurate control, the pump can be a downhole pump, immediately adjacent the test interval.

The present invention will now be described by way of example, with reference to the accompanying drawings, in which.

Figure 1:
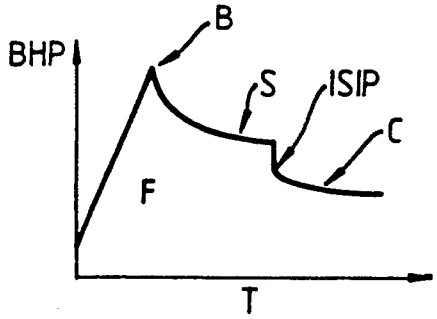
Fig.1. PRIOR ART
FIG. 1 shows a typical plot of borehole pressure (BHP) against time (T) for a conventional μHF test.
Figure 2:
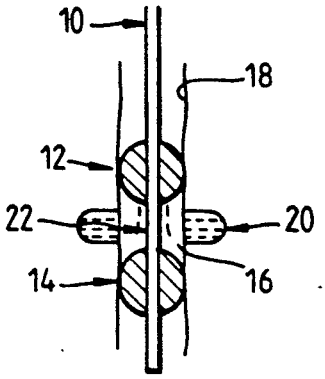
FIG. 2 shows a diagramatic view of an apparatus for performing a method according to the invention.
Figure 6:
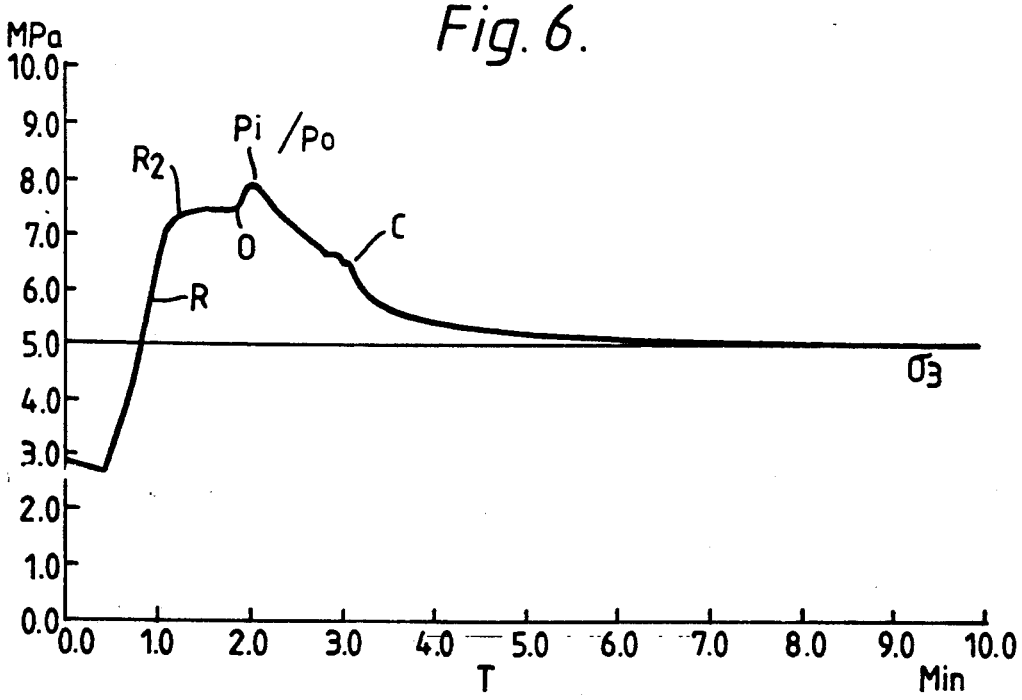
FIG. 6 shows a more detailed practical example corresponding to FIG. 4.

FIG. 2 shows a typical μHF tool comprising a tubing line 10 connected to a pump (not shown) for a fracturing fluid such as mud or water. Packer modules 12, 14 are mounted on the tube line 10 for isolating an interval 16 of the borehole 18. The portion of the line 10 between the packers 12, 14 is provided with injection ports 22 to allow fluid to be pumped into or out of the test interval 16. By inflating the packers 12, 14 and pressurizing the test interval 16 a fracture 20 can be created. Although not shown, the pump and a pressure sensor are preferably mounted on the line 10 immediately adjacent the tool to reduce response time and minimize any tube line storage effect and increase accuracy as less fluid must be injected or removed to effect a noticeable increase or decrease in pressure.

The test interval 16 has a typical length of 2 feet (60 cm) and each packer 12, 14 is typically 5 feet (150 cm) long, giving a total length of 12 feet (360 cm). To obtain the required results, the fracture 20 must remain effectively within this limit. Consequently, a fracture length of the order of 1 m is desired.

Figure 3:
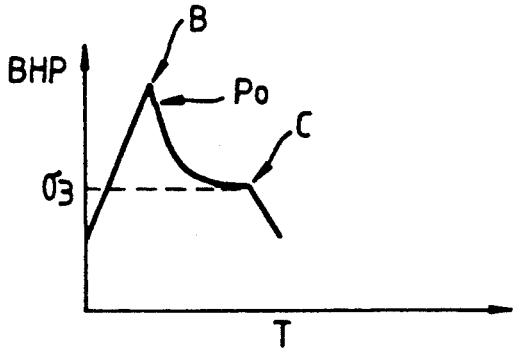
FIG. 3 shows a typical BHP vs T plot for the initial fracture and pump-out phase of a method according to the invention.

Referring now to FIG. 3, the test interval is pressurized as with conventional μHF by pumping fluid into the test interval using a constant displacement pump. However, in this case the pump in rate is much lower than usual, typically $10^{-4}$ liter/sec$-100\times10^{-4}$ liter/-sec. The pressure in the test interval is closely monitored and increases until a fracture is initiated (B) at which time the pressure breakdown is observed. As soon as this point is reached, the pumping direction is reversed so that fluid is withdrawn from the test interval at substantially the same rate as it was pumped in. This is intended to restrict propagation of the fracture to a minimum and at the pumping rates given above, in low permeability formations, the fracture would be expected to propagate at around 1 m/min. Thus to restrict the fracture length to the limits indicated above, the pumping out (PO) should commence within 10–30 seconds of breakdown. The pressure is monitored during the pump-out phase and the pressure at which the fracture closes (C) can be determined form the discontinuity in the pressure decrease which can be seen. The closure stress (C) is a measure of the minimum stress for the formation $\sigma 3$ and the pump back is continued well beyond this to ensure that the fracture is closed and substantially free of fluid.

Figure 4:
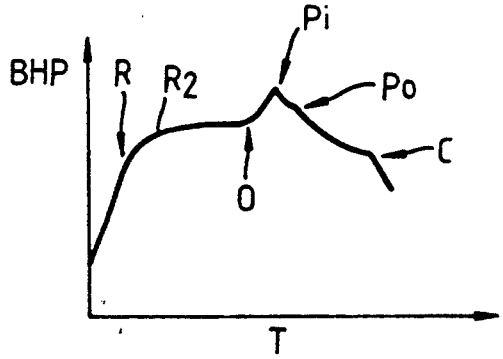
FIG. 4 shows a typical BHP vs T plot for a repressurization and pump back subsequent to that shown in FIG. 3.
Figure 5:
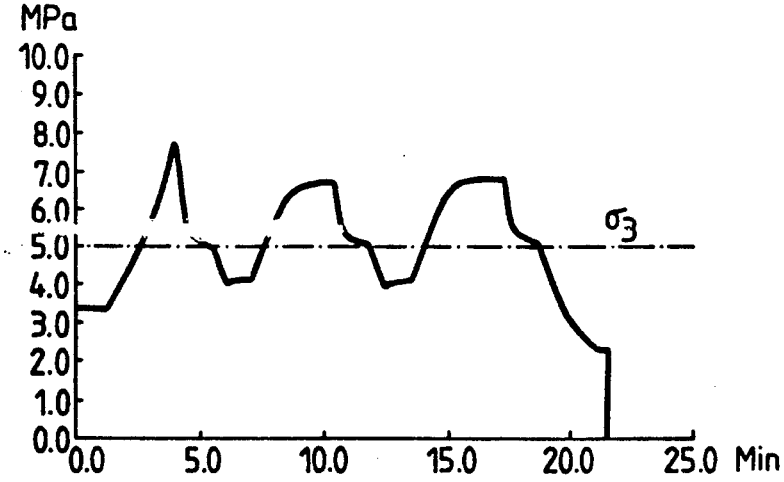
FIG. 5 shows a BHP (MPa) vs T (min) plot for an experimental use of the method.

After the fracture is closed fully, the test interval is repressurized as shown in FIG. 4. The repressurization is essentially the same as the initial pressurization but analysis of the pressure changes shows further information about the formation and the fracture. Again fluid is pumped out once breakdown is observed indicating re-initiation of the fracture. In the repressurization phase, a pressure increase is seen as the interval pressurized. At a pressure (R) greater than the closure stress, the fluid re-enters the fracture created in the first phase. After ($R_2$) the pressure stabilises as the fluid penetrates to the end of the existing fracture. The pressure then begins to rise again as the fracture opens (O) until the pressure is sufficient to re-initiate fracturing ($p_i$) at which point pump back is commenced as before and closure effected. The repressurisation can be repeated several times (see FIG. 5) to confirm the results although some variation will occur in each phase due to the inevitable propagation of the fracture during each pressure phase.

The linear slope which is observed during the second pressure increase is a measure of the compressibility of a fracture of constant length and therefore provides a measurement of the crack shape once the effect of wellbore compressibility is removed (the compressibility of the wellbore is measured from the pressure response during the injection prior to breakdown). For example, if it is assumed that the crack is radial then:

$$\Delta V = 16\,\Delta P \frac{1-\nu^2}{E} R^3 \tag{1}$$

in which V is the volume of fluid in the fracture, P the pressure, E the Young's modulus, v the Poisson's ratio and R the crack length. Once the crack size has been determined, the re-initiation pressure $p_i$ and the value of $\sigma 3$ determined previously is used to compute the fracture toughness:

$$\Delta P = p_i - \sigma_3, \text{ and } K_{Ic} = 2(p_i - \sigma_3)\sqrt{\frac{R}{\pi}} \tag{2}$$

This approach has been tested on a shale which provided a measurement of $K_{Ic}$ of 0.4 MPa $\sqrt{m}$ which is in agreement with the known fracture toughness of the rock tested.

During the second injection test, the time between the fracture re-opening (R) and the pressure increase observed when the fluid reached the crack tip (O) is easily measured. It corresponds to the propagation of a fracture without toughness effect. This portion can be used to validate a propagation model because the propagation pressure and the time needed to reach a given length is known. It is also possible to maintain the pressure at a low value once the fluid has reached the tip of the crack and record the fluid loss to measure the permeability and the far-field pore pressure using an injection area larger than the one obtained in a PBU or RFT test.

These analyses can be performed at each injection test (although the influence of the fracture toughness will be more and more negligible) allowing the determinations to be checked. Measurements using a series of injections, and therefore of various crack lengths allow the pressure response to be interpreted with a more elaborate model (eg elliptical crack shape).

An indication of the actual fracture length required to obtain accurate sensible measurements can be determined from situations where fracture toughness can be estimated. For example if $K_{Ic}$ is of the order of 1 MPa $\sqrt{m}$, which it often is, and if a $\Delta P$ of 1 MPa is measured with reasonable accuracy then from (2) above $R \approx 0.75$ m, i.e. in the order of 1 m as would appear to be necessary with this test geometry in low permeability formations.

The method of the present invention is conveniently performed using a tool such as that described in U.S. Pat. No. 4,860,581 and 4,936,139 which are incorporated herein by reference.

In each case, the tool is a modular tool and includes a hydraulic power source, a packer unit and a pumpout unit. By including a sample chamber which can be connected to the test interval, a sudden pressure drop can be caused in the test interval when a fracture is detected so as to prevent fracture propagation. A flow control module can assist in determining the pressures and flow rates for the test interval.

Modification of the tools to accommodate the pressure requirements in use may be required.

I claim:

1. A method of performing rock fracture measurements in a formation traversed by a borehole, said method comprising:

a) isolating a portion of the borehole with respect to the remainder thereof so as to define a test interval;

b) pumping a fluid into the test interval;

c) monitoring the pressure of the fluid so as to detect the initiation of a fracture in the formation;

d) removing fluid from the test interval on detection of a fracture so as to prevent propagation substantially beyond the influence of the test interval and allow closure thereof; and e) repressurizing the test interval after fracture closure by pumping fluid into the test interval so as to reopen the fracture and monitoring the pressure so as to detect propagation of the fracture.

2. A method as claimed in claim 1, comprising removing fluid from the test interval to prevent further propagation after detection of fracture propagation on repressurization of the test interval.

3. A method as claimed in claim 2, comprising repeating the steps of repressurizing and removing fluid before the fracture has propagated substantially beyond the influence of the test interval.

4. A method as claimed in claim 1, comprising limiting propagation of the fracture to about 1 m.

5. A method as claimed in claim 1, comprising removing fluid within about 30 seconds of detecting a fracture.

6. A method as claimed in claim 1, comprising pumping fluid into and removing fluid from the test interval at 1 to $100\times10^{-4}$ litre/sec.

7. A method as claimed in claim 1, comprising isolating a portion of uncased borehole to define the test interval.

8. A method as claimed in claim 1, comprising pumping fluid out of the test interval on detection of a fracture.

9. A method as claimed in claim 8, comprising pumping the fluid out of the test interval to prevent further propagation after detection of fracture propagation on repressurization of the test interval.

10. A method as claimed in claim 9, comprising repeating the steps of repressurizing and pumping out before the fracture has propagated substantially beyond the influence of the test interval.

11. A method as claimed in claim 8, comprising limiting propagation of the fracture to about 1 m.

12. A method as claimed in claim 8, comprising pumping out within about 30 seconds of detecting a fracture.

13. A method as claimed in claim 8, comprising pumping fluid into and out of the test interval at 1 to $100\times10^{-4}$ litre/sec.

14. A method as claimed in claim 8, comprising isolating a portion of uncased borehole to define the test interval.

15. A method of measuring the minimum stress and fracture toughness of a formation traversed by a borehole, said method comprising:

a) isolating a portion of the borehole with respect to the remainder thereof so as to define a test interval;
b) pumping a fluid the test interval;
c) monitoring the pressure of the fluid so as to detect the initiation of a fracture in the formation;
d) removing fluid from the test interval on detection of a fracture so as to prevent propagation substantially beyond the influence of the test interval and allow closure thereof;
e) repressurizing the test interval after fracture closure by pumping fluid into the test interval so as to reopen the fracture and monitoring the pressure so as to detect propagation of the fracture;
f) determining the minimum stress and fracture toughness from the pressure measurements during pressurization and depressurization of the test interval.

16. A method as claimed in claim 15, comprising measuring the pressure at which the fracture closes to determine the minimum stress of the formation.

17. A method as claimed in claim 15, comprising pumping fluid out of the test interval on detection of a fracture.

18. A method as claimed in claim 17, comprising pumping the fluid out of the test interval to prevent further propagation after detection of fracture propagation on repressurization of the test interval.

19. A method as claimed in claim 18, comprising repeating the steps of repressurizing and removing fluid before the fracture has propagated substantially beyond the influence of the test interval.

20. A method of measuring the minimum stress and fracture toughness of a formation traversed by a borehole said method comprising;

a) isolating a portion of the borehole with respect to the remainder thereof so as to define a test interval;
b) pumping a fluid into the test interval;
c) monitoring the pressure of the fluid so as to detect the initiation of a fracture in the formation;
d) pumping the fluid out of the test interval on detection of a fracture so as to prevent propagation and allow closure thereof;
e) repressurizing the test interval after fracture closure by pumping fluid into the test interval so as to reopen the fracture and monitoring the pressure so as to detect propagation of the fracture; and
f) from the pressure measurements during pressurization and depressurization of the test interval, measuring the pressure at which the fracture closes to determine the minimum stress of the formation and measuring the pressure at which the fracture propagates on repressurization of the test interval so as to calculate the fracture length and the fracture toughness.

* * * * *